US005103581A

United States Patent [19]

Novak

[11] Patent Number: 5,103,581

[45] Date of Patent: Apr. 14, 1992

[54] DELIVERY ALERT APPARATUS

[76] Inventor: Steve M. Novak, 111 Passaic Ave., Apt. #B14, Nutley, N.J. 07110

[21] Appl. No.: 688,979

[22] Filed: Apr. 22, 1991

[51] Int. Cl.[5] ..... G09F 13/00

[52] U.S. Cl. ..... 40/547; 40/617; 362/32

[58] Field of Search ..... 40/541, 547, 617, 152, 40/1.5, 564, 579; 362/32

[56] References Cited

U.S. PATENT DOCUMENTS

| | | | |
|---|---|---|---|
| 2,277,088 | 3/1942 | Ehrenhaft | 40/617 X |
| 2,354,367 | 7/1944 | Ford | 40/547 |
| 4,745,525 | 5/1988 | Sheehy | 362/32 |

FOREIGN PATENT DOCUMENTS

| | | | |
|---|---|---|---|
| 371116 | 4/1932 | United Kingdom | 40/152 |
| 1507883 | 4/1978 | United Kingdom | 40/547 |

*Primary Examiner*—Kenneth J. Dorner
*Assistant Examiner*—Brian K. Green
*Attorney, Agent, or Firm*—Leon Gilden

[57] ABSTRACT

An apparatus arranged for mounting exteriorly of a dwelling and the like for alerting a delivery individual of proper location of a delivery site, such as utilized in pizza delivery, to minimize delay of time while the delivery individual is seeking a proper dwelling for delivery of an associated pizza.

1 Claim, 4 Drawing Sheets

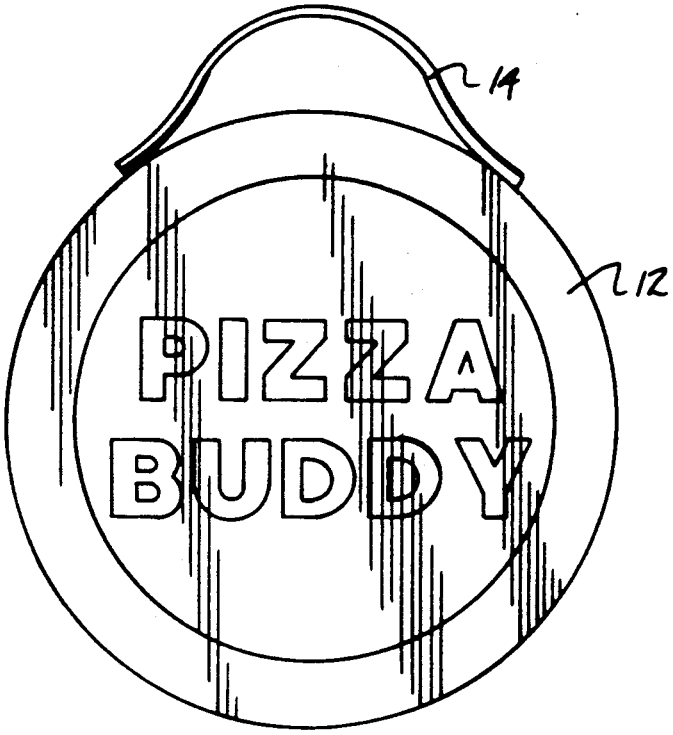
FIG 2
FIG 3
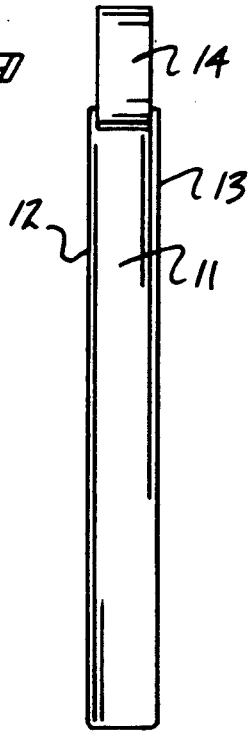

11
13
14
16
17
18
18
19
20
21
22
24

DELIVERY ALERT APPARATUS

BACKGROUND OF THE INVENTION

1. Field of the Invention

The field of invention relates to signal devices, and more particular pertains to a new and improved delivery alert apparatus wherein the same is arranged to alert delivery individuals of proper location of a delivery site.

2. Description of the Prior Art

Various signal and alert apparatus has been utilized in the prior art to provide indication of positioning of a delivery form for delivery of various items.

U.S. Pat. No. 4,931,780 to Lamont, et al. sets forth an illuminated address identifier and alarm setting forth an illuminated address housing.

U.S. Pat. No. 2,856,631 to Jorick, Jr. wherein an illuminated indicator utilizes a signal illumination bulb mounted within a housing for illumination of the housing.

U.S. Pat. No. 4,887,195 to Donelan sets forth a further example of an illuminated enclosure mounting an indicator numeral through a forward face thereof.

Similarly, U.S. Pat. Nos. 2,662,3356 to Valente and U.S. Pat. No. 4,272,901 to Matthews set forth further examples of illuminated address indicators.

As such, it may be appreciated that there continues to be a need for a new and improved delivery alert apparatus as set forth by the instant invention which addresses both the problems of ease of use as well as effectiveness in a portable and readily mounted enclosure for selective indication of a delivery site and in this respect, the present invention substantially fulfills this need.

SUMMARY OF THE INVENTION

In view of the foregoing disadvantages inherent in the known types of alert apparatus now present in the prior art, the present invention provides a delivery alert apparatus wherein the same sets forth a selectively illuminated enclosure readily mounted to a support for providing indication of proper location of a delivery site. As such, the general purpose of the present invention, which will be described subsequently in greater detail, is to provide a new and improved delivery alert apparatus which has all the advantages of the prior art alert apparatus and none of the disadvantages.

To attain this, the present invention provides an apparatus arranged for mounting exteriorly of a dwelling and the like for alerting a delivery individual of proper location of a delivery site, such as utilized in pizza delivery, to minimize delay of time while the delivery individual is seeking a proper dwelling for delivery of an associated pizza.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is another object of the present invention to provide a new and improved delivery alert apparatus which may be easily and efficiently manufactured and marketed.

It is a further object of the present invention to provide a new and improved delivery alert apparatus which is of a durable and reliable construction.

An even further object of the present invention is to provide a new and improved delivery alert apparatus which is susceptible of a low cost of manufacture with regard to both materials and labor, and which accordingly is then susceptible of low prices of sale to the consuming public, thereby making such delivery alert apparatus economically available to the buying public.

Still yet another object of the present invention is to provide a new and improved delivery alert apparatus which provides in the apparatuses and methods of the prior art some of the advantages thereof, while simultaneously overcoming some of the disadvantages normally associated therewith.

Still another object of the present invention is to provide a new and improved delivery alert apparatus wherein the same provides selectively illuminated indicia mounted to a forward face of a housing, wherein the indicia are provided with economy of manufacture and efficiency of use of an associated bulb and battery member to utilize fiber optic cables to direct illumination to various discrete of indicia directed to the forward face of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic front view, taken in elevation, of the instant invention.

FIG. 3 is an orthographic side view, taken in elevation, of the instant invention.

DESCRIPTION OF THE PREFERRED EMBODIMENT

Figure 1:
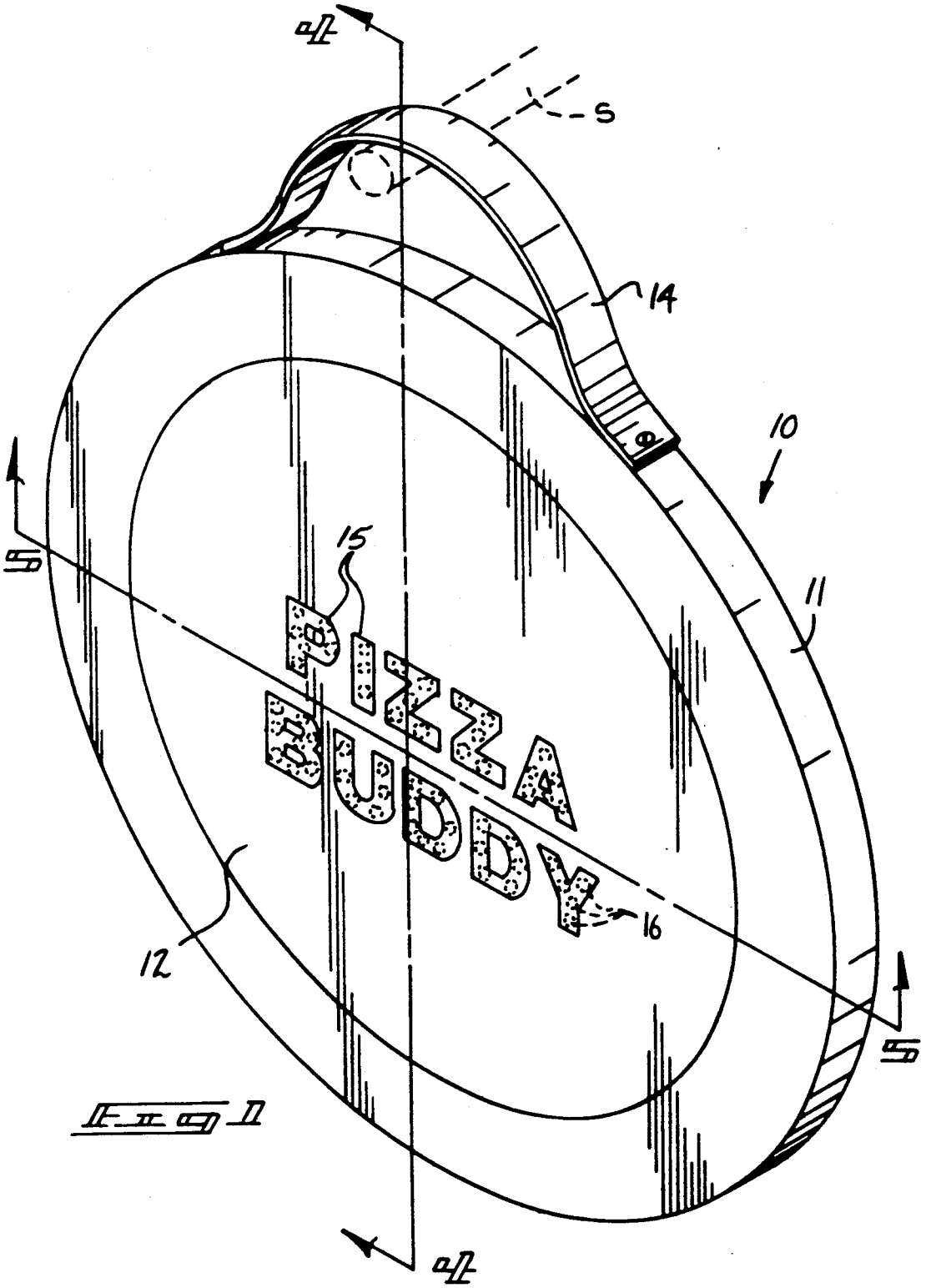
FIG. 1 is an isometric illustration of the instant invention.
Figure 4:
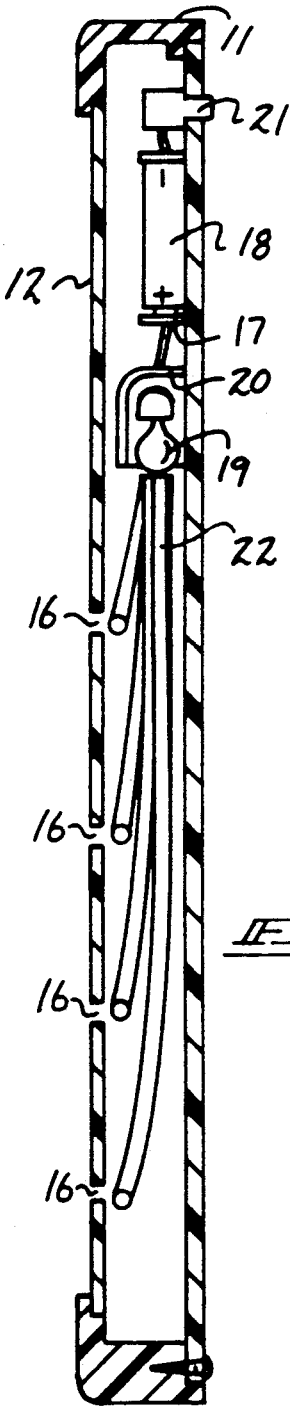
FIG. 4 is an orthographic view, taken along the lines 4—4 of FIG. 1 in the direction indicated by the arrows.
Figure 5:
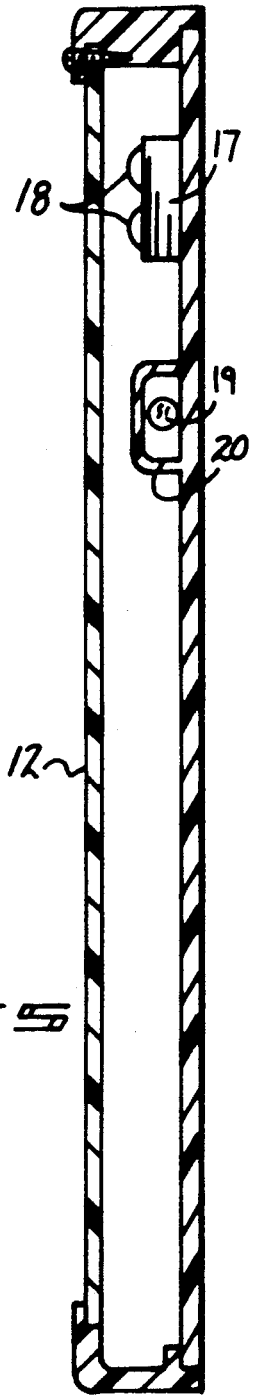
FIG. 5 is an orthographic view, taken along the lines 5—5 of FIG. 1 in the direction indicated by the arrows.
Figure 6:
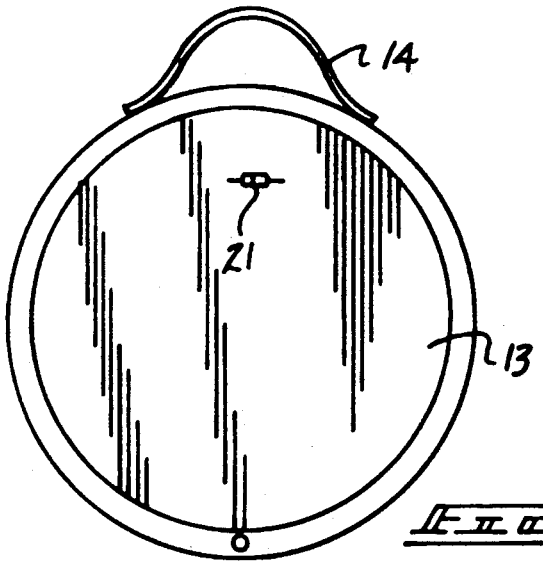
FIG. 6 is an orthographic rear view of the invention taken in elevation.
Figures 7, 8:
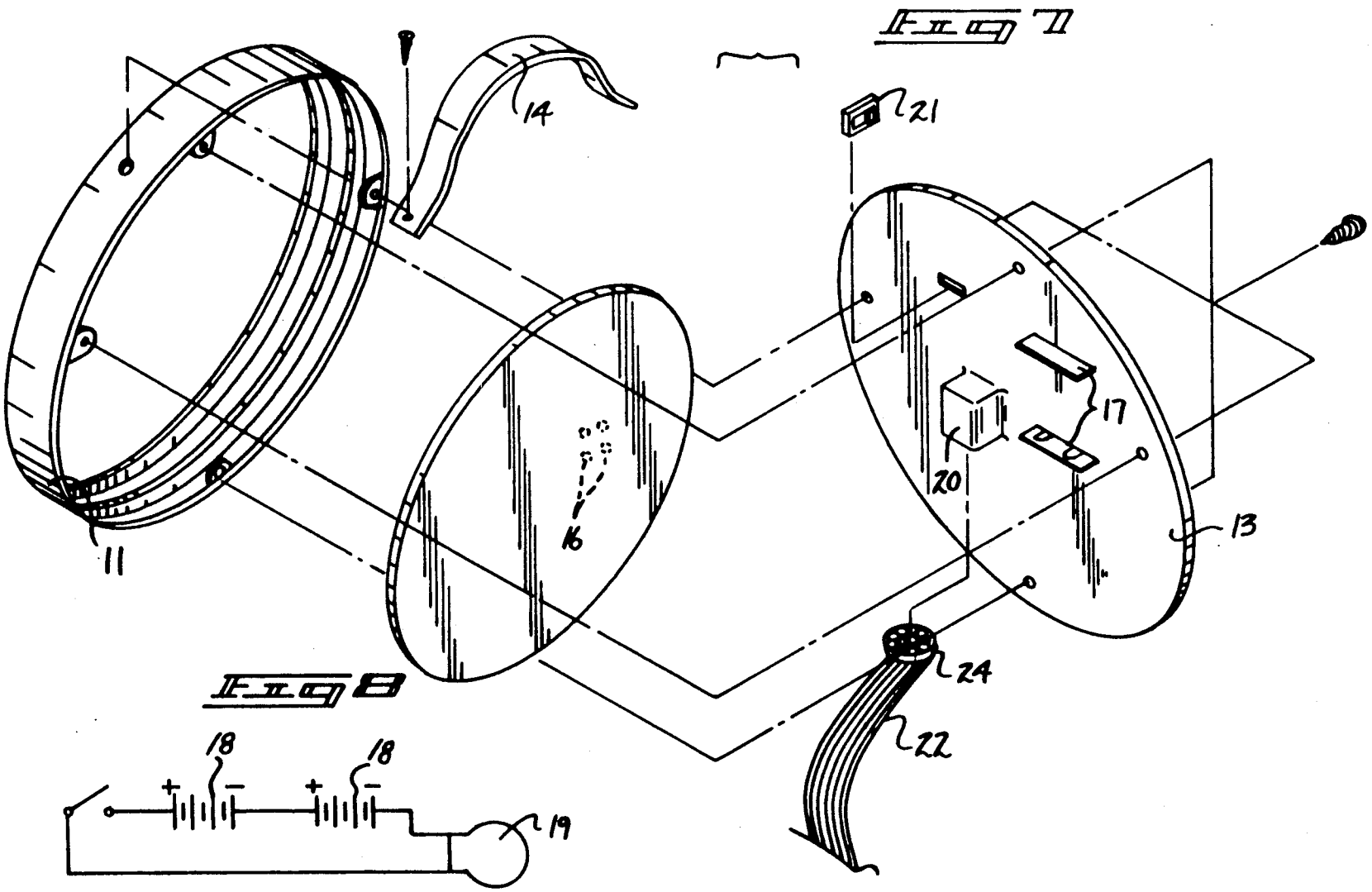
FIG. 7 is an isometric exploded illustration of the instant invention.
FIG. 8 is a diagrammatic electrical circuit utilized the instant invention.

With reference now to the drawings, and in particular to FIGS. 1 to 8 thereof, a new and improved delivery alert apparatus embodying the principles and concepts of the present invention and generally designated by the reference numeral 10 will be described.

More specifically, the delivery alert apparatus 10 of the instant invention essentially comprises a housing, including a cylindrical side wall 11, with a planar forward wall 12 spaced from and parallel a planar rear wall 13. A handle strap 14 is fixedly mounted to the cylindrical side wall 11 defining a gap to receive a support "S" therebetween the handle and the side wall for support of the organization for providing indication of a location for delivery. Indicia members 15 are directed through the forward wall 12, wherein each of the indicia members 15 include a matrix of indicia openings 16 therebetween. A predetermined number of indicia openings 16 ar directed through the forward wall 12. Within the housing is mounted a battery housing 17 providing support for a single or plurality of batteries 18 in electrical communication with an illumination bulb 19 that is mounted within a reflector housing 20. The reflector housing 20 defines an opening over a matrix of fiber optic cables 22. The illumination bulb is operative through a switch 21 that projects through the rear wall 13. The fiber optic cables are defined by a predetermined number of fiber optic cables, each provided with a fiber optic cable end 23. Accordingly, a predetermined number of fiber optic cable ends 23 are provided equal to the predetermined number of indicia openings 16. A fiber optic cable end 23 is associated with a respective opening 16 to provide illumination of each opening and thereby provide signaling of various lettering and numbering of the indicia members 15 providing the indicia outlines, as illustrated in FIG. 1 for example. The upper terminal end of the fiber optic cable matrix 22 and the fiber optic cables are secured by a fiber optic cable hoop 24 positioned underlying the opening of the reflector housing 20 and the illumination bulb 19. In this manner, economy of use of bulbs and illumination members are provided to provide prolonged usage of the organization and mounting of the organization adjacent to or remote from a dwelling for use of the indicator or alert apparatus, as required.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the U.S. Is as follows:

1. A delivery alert apparatus, comprising in combination, a housing, the housing includes a continuous side walls, and a planar forward wall spaced from and parallel a planar rear wall, and a flexible handle strap mounted to the side wall, and the strap defining a gap between the handle strap and the side wall, and a support rod, the support rod receivable with the gap, and a plurality of indicia members directed through the forward wall, and the indicia members including illumination mans within the housing to effect illumination of the indicia members, and wherein the indicia members are each defined by indicia openings, and the illumination means includes a battery housing contained within the housing, and at least one battery contained within the battery housing, and a switch member directed through the rear wall, and an illumination bulb mounted within the housing to an interior surface of the rear wall for selective illumination of the illumination bulb through the switch member, and a reflector housing mounted to the interior surface of the rear wall in surrounding relationship relative to the illumination bulb defining a housing opening, and a fiber optic cable matrix mounted within the housing under the housing opening, and each of the predetermined number of fiber optic cables including a fiber optic cable end, and a fiber optic cable end aligned with each indicia opening, and wherein the fiber optic cable matrix defines an upper terminal end, and the fiber optic cable matrix upper terminal end is secured by a fiber optic cable hoop, and the hoop positioned under the housing opening and the illumination bulb.

* * * * *